US007807325B2

(12) United States Patent
Yoshida et al.

(10) Patent No.: US 7,807,325 B2
(45) **Date of Patent: *Oct. 5, 2010**

(54) TONER FOR USE IN ELECTROSTATIC IMAGE DEVELOPMENT

(75) Inventors: Eiichi Yoshida, Tokyo (JP); Masahiko Nakamura, Tokyo (JP); Kaori Soeda, Tokyo (JP); Tomoko Mine, Tokyo (JP); Kenichi Onaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 888 days.

This patent is subject to a terminal disclaimer.

(21) Appl. No.: 11/626,427

(22) Filed: Jan. 24, 2007

(65) Prior Publication Data

US 2007/0190445 A1 Aug. 16, 2007

(30) Foreign Application Priority Data

Feb. 10, 2006 (JP) ..... 2006-033579

(51) Int. Cl.
*G03G 9/08* (2006.01)

(52) U.S. Cl. ..... 430/108.21

(58) Field of Classification Search ..... 430/108.21, 430/108.2, 108.1
See application file for complete search history.

(56) References Cited

U.S. PATENT DOCUMENTS

| | | | | |
|---|---|---|---|---|
| 6,569,589 | B2 * | 5/2003 | Inaba et al. | 430/108.22 |
| 7,556,905 | B2 * | 7/2009 | Yoshida et al. | 430/108.4 |
| 2007/0077510 | A1 * | 4/2007 | Nosella et al. | 430/109.4 |

FOREIGN PATENT DOCUMENTS

JP 03094267 A * 4/1991

* cited by examiner

*Primary Examiner*—Christopher RoDee
(74) *Attorney, Agent, or Firm*—Lucas & Mercanti, LLP

(57) ABSTRACT

An electrostatic image developing toner is disclosed, comprising a resin and a colorant, wherein the toner contains at least one iminocarboxylic acid or its salt in an amount of from 26 to 388 ppm by mass.

6 Claims, 2 Drawing Sheets

TONER FOR USE IN ELECTROSTATIC IMAGE DEVELOPMENT

TECHNICAL FIELD

The present invention relates to toners for use in development of electrostatic images (hereinafter also denoted simply as toners) in image formation by using printers and copiers of an electrophotographic system.

RELATED ART

The need for color image formation by using an electrophotographic image forming apparatus represented by laser printers or multifunction printers (MFP) are regarded to make further expansion. To realize further popularization, compactness or easier maintainability is required and to satisfy such needs, a color image forming apparatus using a nonmagnetic mono-component toner which enables image formation without a carrier is mainly used. The image forming method by using a nonmagnetic mono-component toner mainly adopts a method in which a latent image formed on an electrostatic latent image carrier is developed by a mono-component toner conveyed or supplied by a toner carrier such as a developing roller to form a toner image. The formed toner image is transferred onto a recording material and the toner image on the recording material is then thermally fixed.

Recently, rapid full-color image formation has been desired in making data or bulletins in offices. When performing high-speed printing in a compact color printer, rapid and stable charge-rising performance is required in the toner. As a technique to meet such needs, for instance, rapid rise in charging was achieved by a pulverized toner containing a polyester resin, a colorant and a charge controlling agent, as disclosed, for example, in JP-A No. 2000-235280 (hereinafter, the term JP-A refers to Japanese Patent Application Publication).

However, electrostatic charging characteristics of the toner disclosed in the foregoing patent document greatly depend on the toner composition, additives and the particle size distribution or shape of the toner, leading to insufficient performance. Moreover, when conducting continuous printing, lowering of image density, caused by charge-up tends to occur gradually.

Development of so-called polymerization toners which are prepared via a step of coagulate resin particles in an aqueous medium is remarkable in recent technical trends of toners. Such polymerization toners are suitable for preparation of a toner of small particle sizes and uniform shape or particle size distribution, enabling to provide a toner suitable for pictorial image formation, as described, for example, in JP-A No. 2000-214629.

Recently, along with downsizing of image forming apparatuses, a compact developing device is used in an image forming apparatus. Such a downsized developing device gave stronger impact onto toner particles from a stirring member or a thin layer-forming member, leading to concern of cause crushing of toner particles in the interior of the compact developing device. Fine powder produced by crushing of toner particles adheres onto the surface of the developing roller, causing filming or resulting in toner scattering. To prevent crushing of nonmagnetic mono-component toner particles, for instance, a technique of preparing a toner having a specific softening point, particle hardness and average circularity coefficient through particle formation in an aqueous medium, is described, for example, in JP-A No. 2000-14629.

As a technique for preventing lowering of density by using a polymerization toner in continuous printing, for example, there was disclosed a technique in which a polymerization toner was prepared using a combination of a positive charge controlling resin and a negative charge controlling resin, whereby droplets of a monomer composition was stabilized in an aqueous suspension medium, leading to formation of fine toner particles exhibiting a narrow particle size distribution, as described in JP-A No. 2000-347445.

SUMMARY OF THE INVENTION

It was confirmed that when the foregoing technique described in JP-A No. 2000-347445 is applied to image formation by using a nonmagnetic mono-component toner, performing sufficient rise in charging was difficult, depending on installation environment of an image forming apparatus. Specifically, when conducting continuous printing under low temperature and low humidity, lowering of density was marked. Further, in nonmagnetic mono-component toner development, strong impact is ordinarily applied to the toner particles, causing concerns for durability of the toner, for instance, such as crushing of toner particles.

The present invention has come into being in view of the foregoing problems.

It is an object of the invention to provide an electrostatic image developing toner which can perform prompt rise of electrostatic charge without being affected by installation environment of the image forming apparatus.

One aspect of the invention is direct to an electrostatic image developing toner comprising a resin and a colorant, wherein the toner contains an iminocarboxylic acid or its salt in an amount of from 26 to 388 ppm by mass.

According to the invention, prompt rise of electrostatic charge of a toner is performed, whereby a toner with a stable charge is supplied onto an image carrier, performing rapid formation of a high quality toner image. Specifically, an image forming apparatus which performs prompt printing via a compact development device by using a nonmagnetic mono-component toner, can rapidly and stably produce full-color prints.

In the invention, prints with consistent image quality can be provided without variation of toner image density, even in an image formation environment resulting in lowering of density, as is noted in the prior art, for example, in continuous printing under low temperature and low humidity.

In the invention, image formation is performed under reduced load onto a developing device, for instance, reduced abrasion loss of the developing roller during image formation with increasing its life, rendering it feasible to make prints of superior image quality stably over a significantly longer period of time.

The invention is related to a toner used for development of an electrostatic image, which contains a definite amount of an iminocarboxylic acid or its salt.

Thus, the toner of the invention achieves prompt rise of electrostatic charge and image formation is performed by using such a toner with a stable charge. The reason for this result is not clarified but it is assumed that an imino group site or a carboxyl group site in an iminocarboxylic acid contained in the toner is ionized and a formed ammonium ion or carboxyl ion stabilizes the charge generated on the toner particle surface. It is further assumed that an iminocarboxylic acid itself prevents increased charging due to the residue of a polymerization initiator, such as a sulfate ion. It is therefore presumed that stable image formation is performed along with prompt rise of electrostatic charge, without causing lowering of density even under an environment easily resulting in an increase of charging on the toner particle surface, for instance, when conducting continuous printing under low temperature and low humidity.

In the invention, load applied to a developing device during image formation is reduced, leading to reduced abrasion loss of the developing roller and enabling increased life of the developing device. The reason for the reduced abrasion is assumed to be that an iminocarboxylic acid included in the toner prevents excessive charging of the toner, rendering it free of stagnation of the toner or coagulants of external additives which tends to occur on the developing roller or at the point of contact of a toner layer controlling member and the developing roller.

DETAILED DESCRIPTION OF THE INVENTION

Figure 1:
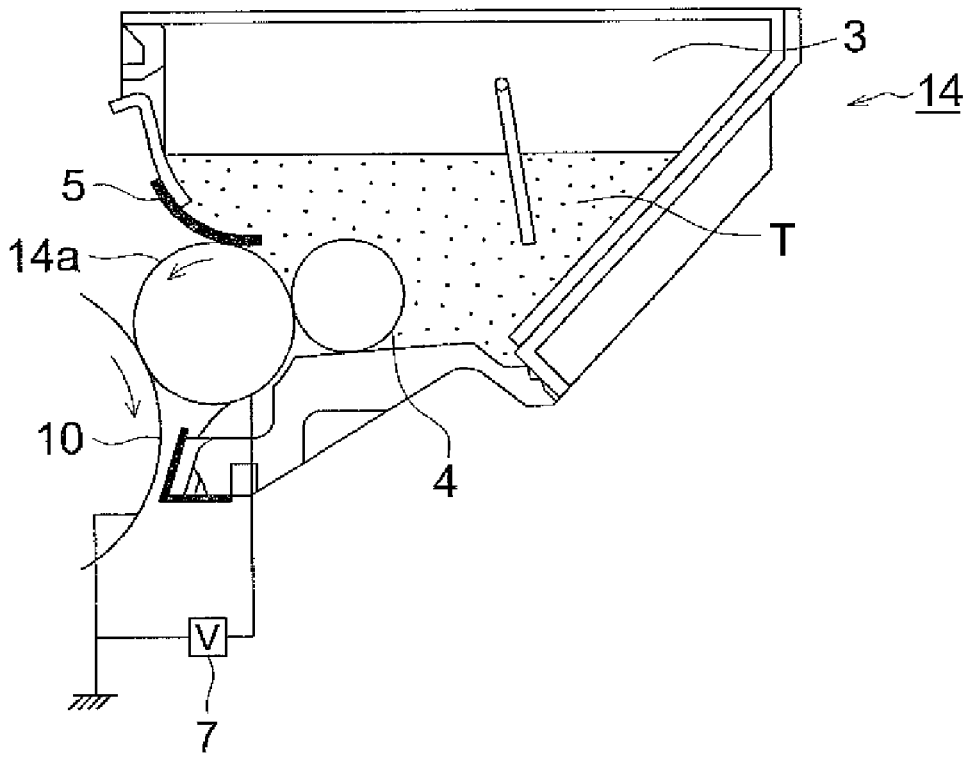
FIG. 1 illustrates the section of a developing device used for a nonmagnetic monocomponent developer.

The toner of the invention contains an iminocarboxylic acid or its salt in an amount of 26 to 388 ppm by mass. The iminocarboxylic acid is an organic carboxylic acid having a structure of a hydrogen-attached nitrogen atom (—NH—) being bonded to one or two carbon atoms.

In the invention are also usable metal salts of an iminocarboxylic acid, in which a metal ion is bonded to a dissociative group of the iminocarboxylic acid. Salts of a univalent metal, so-called alkali metal such as sodium, potassium or lithium are preferable. If the hydrogen atom of a carboxyl group of an iminocarboxylic acid is substituted with a metal atom described above, a metal salt of the acid is obtained.

Specific examples of an iminocarboxylic acid compound usable in the invention is shown below:

(8-3)

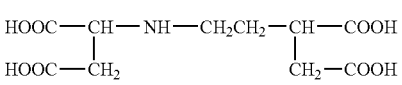

(9-2)

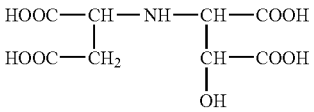

(9-3)

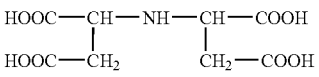

(9-4)

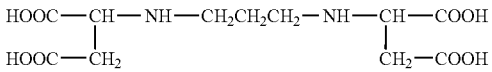

(9-5)

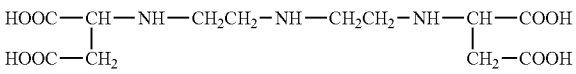

Of the foregoing iminocarboxylic acid compounds, compounds (8-3), (9-2), (9-3) and their sodium salts are preferred in the invention.

The amount of an iminocarboxylic acid or its salt contained in the toner of the invention can be determined in the manner described below.

1. A toner to be measured is subjected to the following extraction procedures (1-1) and (1-2).

1-1. 500 mg of the toner is added to 10 ml of a methanol solution containing 1N hydrochloric acid and dispersed for 5 min. in an ultrasonic homogenizer to obtain a dispersion.

1-2. The dispersion is filter by a chromato-disk with a pore size of 0.2 μm and the filtrate is diluted 10 times with pure water.

2. A solution obtained in the foregoing procedure (1-2) is analyzed by ion chromatography under the condition (2-1) described below. Determination of chemical structure is performed with respect to the peak obtained after separation, according to the conventional methods. Specifically, identification is carried out in mass spectrometry and nuclear magnetic resonance (NMR) spectrometry. After completing determination of the chemical structure, a calibration curve is prepared using a standard sample of the same structure in an ion chromatography apparatus. The concentration of an extract from the toner is calculated based on comparison of the peak area, from which the amount of an iminocarboxylic acid contained in the toner is determined. In cases where plural iminocarboxylic acids are contained, their sum is defined as the amount of iminocarboxylic acid.

2-1. Ion chromatography condition:

Detection: UV 210 nm

Column: TOSO-made ODS-80 TM 4.6×250 m+TOSO-made ODS-80 TM 4.6×150 mm

Flow rate: 0.5 ml/min

Mobile phase: 5 mM ammonium dihydrogen phosphate (pH=2.4)

Column temperature: 25° C.

Analysis amount: 20 μl

Analysis time: 45 min.

The mobile phase was prepared by dissolving 1.15 g of ammonium dihydrogen phosphate (super grade) in 1980 g of deionized water and adjusting the pH to 2.40 with 85 wt % phosphoric acid, followed by addition of deionized water with stirring to make 2000 g.

The toner of the invention contains preferably 1 to 1800 ppm of sodium in an amount represented by equivalent converted to sodium element.

The toner of the invention contains preferably 300 to 1800 ppm (more preferably 600 to 140 ppm) of a divalent or trivalent metal element. The divalent or trivalent metal element refers to a metal element capable of giving a divalent or trivalent metal ion. Examples thereof include divalent metals such as calcium, magnesium, manganese, copper and zinc, and trivalent metals such as aluminum and iron.

The amount of metals contained in a toner (or metal content of a toner) can be determined by an inductively coupled plasma (ICP) spectrometer.

The metal content of a toner can be determined in the following manner. First, 0.1 g of a toner is weighed out, 1.5 ml of sulfuric acid is added thereto and a carbonization treatment is carried out by using microwaves. To the thus carbonized material, 0.5 ml of nitric acid and 1.5 ml of hydrogen peroxide are added and a decomposition treatment is conducted by using microwaves. Thus decomposed material is dissolved in distilled water to make a solution of 50 ml in a mess flask. The solution is measured in an inductively coupled plasma spectrometer to determine contents of sodium and divalent or trivalent metals. Examples of an inductively coupled plasma spectrometer include the ICP emission spectrometer SPS 7800 series, SPS 3100 series and SPS 5100 series, produced by Seiko Instrument Co., Ltd. (SII Nanotechnology Co., Ltd.) and ICP emission analyzer CIROS Mark II (produced by RIGAKU Co., Ltd.).

Next, there will be described physical properties of the toner of the invention.

The volume median diameter ($D_{50}$) of the toner of the invention is preferably from 3 to 9 μm.

The volume median diameter ($D_{50}$) or the coefficient of variation of volume-based particle size distribution of the toner can be measured and determined by using Coulter Multisizer III (Beckman Coulter Co.) connected to a computer system for data processing (Beckman Coulter Co.), according to the following procedure. An amount of 0.02 g of a toner is added to 20 ml of a surfactant solution (which is prepared by diluting a neutral detergent containing surfactant components 10 times with pure water) and dispersed for 1 min. by using an ultrasonic homogenizer to obtain a toner dispersion. The toner dispersion is poured by a pipette into a beaker in which ISOTON II (Beckman Coulter Co.) is placed with a sample stand, until reaching 8% by mass of a measurement concentration. The measurement count is set to 2500 to perform measurement. The aperture diameter of Coulter Multisizer is 50 μm.

The toner of the invention preferably exhibits 8-21% (more preferably 10-19%) of a coefficient of variation in volume-based particle size distribution. The coefficient of variation in volume-based particle size distribution is calculated according to the following equation:

$$\text{coefficient of variation in volume-based particle size distribution (\%)} = (S2/Dn) \times 100$$

wherein S2 represents a standard deviation of volume-based particle size distribution and Dn represents a volume median diameter ($D_{50}$).

The toner of the invention preferably exhibits an average circularity of 0.951 to 0.990.

The circularity of a toner is defined as below:

circularity=(circumferential length of a circle having an area equivalent to the projection of a toner particle)/(circumferential length of the projection of a toner particle)

The average circularity is the sum of circularities of the total toner particles, divided by the number of the total toner particles.

The circularity of a toner can be determined using FPIA-2100 (Sysmex Co.). Specifically, a toner is added to an aqueous surfactant-containing solution and dispersed for 1 min. by using an ultrasonic homogenizer to prepare a dispersion. The dispersion is measured with FPIA-2100. The measurement condition is set to HPF (high power focusing) mode and the measurement is carried out at an optimum concentration of the HPF detection number of 3000-10000.

Methods for manufacturing the toner of the invention are not specifically limited but a manufacturing method in which resin particles are formed through emulsion polymerization and coagulated to form toner particles, is preferred.

There will be described an example of a manufacturing method of a toner to prepare the toner via coagulation of resin particles. The stage of adding an iminocarboxylic acid is not specifically limited but addition in the step (2) described below is preferred. It is preferred to estimate in advance the amount of an iminocarboxylic acid compound to be added to the toner through preliminary experiments since a part of the iminocarboxylic acid compound is eluted.

The toner of the invention is preferably manufactured through a process comprising:

(1) a polymerization step of polymerizing a polymerizable monomer to prepare a dispersion of resin particles, (2) a coagulation step of coagulating constituent materials of toner particles, such as resin particles and colorant particles in an aqueous medium to form a toner particle intermediate (or toner particle precursor) forming a parent of a toner (hereinafter, also denoted as a step of coagulating resin particles), (3) a shape control step of performing heating with stirring subsequently to the step of coagulating resin particles to complete fusion of material constituting the toner particle intermediate simultaneously with controlling the shape to form toner particles, (4) a solid-liquid separation and washing step of separating the toner particle intermediate from the aqueous medium concurrently with washing the surface of the toner particle intermediate, (5) a drying step of drying the toner particle intermediate which has been treated in the solid-liquid separation and washing step, and (6) an external additive treatment step of adding external additives to the dried toner particle intermediate to produce a toner usable for image formation.

The respective steps will be further detailed below.

Polymerization Step:

In one preferred embodiment of the polymerization step, a radical polymerizable monomer solution is added to an aqueous medium containing a surfactant and mechanical energy is applied thereto to form droplets. Subsequently, a radical generated from a radical polymerization initiator causes a polymerization reaction to proceed within the droplets. Resin particles as nucleus particles may be added to the foregoing aqueous medium.

Polymerization is preferably divided into a few steps with varying the amount of a chain transfer agent to control the molecular weight distribution. Resin particles are obtained in this polymerization step. Such resin particles may contain a releasing agent (wax) or a colorant. Colored resin particles are obtained through polymerization of a monomer composition including a colorant. When using non-colored resin particles, a dispersion of colorant particles is added to a dispersion of resin particles, and the resin particles and the colorant particles are coagulated with each other to form a toner particle intermediate (toner parent).

Coagulation Step:

This step is one of coagulating resin particles in an aqueous medium to grow the particles. During this step, that is, when coagulation of resin particles proceeds, preferably, an iminocarboxylic acid or its salt is added to the aqueous medium. In this step, resin particles formed in the polymerization step are coagulated with a toner particle constituting material to form a toner particle intermediate (which refers to particles before providing functions as a toner through a final treatment such as incorporation of external additives and is also called a toner parent or colored particles). In this step, concurrently with coagulation, fusion (or fusion bonding) to allow coagulated particles to be strongly bound to each other is performed by the action of heating or the like.

Preferably, fusion of resin particles and a colorant is allowed to proceed concurrently with coagulation. Alternatively, after completing coagulation, fusion may be performed by an appropriate means such as heating.

Specifically, addition of a di- or tri-valent metal salt to the aqueous medium reduces repulsion between particles such as resin particles or colorant particles, rendering them to be coagulable. The particles coagulate and grow to form a toner particle intermediate. Coagulated particles are bonded by heating to result in fusion. Thus, formation and growth of a toner particle intermediate are performed.

An iminocarboxylic acid or its salt is added preferably in an amount of 0.8 to 2.8 parts by mass per 100 parts by mass. Addition in an amount falling within the foregoing range renders it feasible to come into effects of the invention.

The step of coagulating particles will be further described. In this step, resin particles formed in the polymerization step or colorant particles are coagulated and concurrently, the coagulated particles are fused under an environment at a temperature higher than the glass transition temperature of the resin particles.

Coagulation of particles may also be performed, in which a dispersion of resin particles and a dispersion of colorant particles are mixed at a temperature lower than the glass transition temperature of the resin particles and the temperature is raised with coagulating the particles to concurrently result in fusion of the coagulated particles. This method promotes fusion with performing particle growth, leading to advantages that the particle shape and the particle size distribution can be uniformly controlled From such a point of view, a so-called salting out-fusion method is preferred for the step of coagulating resin particles, in which coagulation and fusion concurrently proceed to perform growth until reaching the intended particle size, while continuing heating to control the particle shape.

The aqueous medium relating to the invention refers to one which is comprised mainly of water (of at least 50% by mass). Components other than water include water-soluble organic solvents, for example, methanol, ethanol, isopropanol, butanol and acetone.

Addition of metal salts, such as a divalent metal salt promotes coagulation of particles. Metal salts promoting the coagulation include, for example, monovalent alkali metal salts such as sodium potassium or lithium, divalent metal salts such as calcium, magnesium manganese or copper, and trivalent metal salts such as aluminum or iron. Specific examples include sodium chloride, potassium chloride, lithium chloride, calcium chloride, magnesium chloride, zinc chloride, copper sulfate, magnesium sulfate, and manganese sulfate. These metal salts may be used singly or in combination of two or more. Of these metal salts, a divalent metal salt, which promotes coagulation at a relatively small amount, is preferred.

These metal salts are added preferably at a concentration more than the critical coagulation concentration in an aqueous medium, specifically, preferably at least 1.2 (more preferably at least 1.5) times the critical coagulation concentration. The critical coagulation concentration is a barometer relating to stability of an aqueous dispersion. The critical coagulation concentration can be calculated, for example, by the method described in Kobunshi Kagaku (Polymer Chemistry) vol. 17, page 601 (1960). It can also be calculated in such a manner that a desired salt is added to the objective dispersion with varying its amount, while measuring the $\xi$-potential of the dispersion, and a salt concentration at which the $\xi$-potential changes is defined as the critical coagulation concentration.

In the step of coagulation resin particles, toner particle constituting materials such as wax, a fixing aid or a charge controlling agent may be added together with resin particles and colorant particles.

Shape Controlling Step:

After an iminocarboxylic acid or its salt is added in the foregoing step of coagulating resin particles, stirring is continued with heating to control the shape of a toner particle intermediate (toner parent). Extension of the time of stirring with heating can control the shape of the toner particle intermediate (toner parent) so as to be close to a spherical form.

Solid-Liquid Separation and Washing Step:

From a dispersion containing the toner particle intermediate (toner parent) which has been cooled to a prescribed temperature, the toner particle intermediate (toner parent) is separated (via solid-liquid separation) and washing is conducted to remove unnecessary material such as a surfactant or a salting-out agent from the separated toner cake (a coagulated cake-form block of the wetted toner particle intermediate).

Washing is continued with water until reaching an electric conductivity of 10 μS/cm.

The solid-liquid separation and washing is conducted employing centrifugal separation, vacuum filtration using a Nutsche funnel or the like or a method of using a filter press, but is not specifically limited.

Drying Step:

The drying step is one of subjecting the washed toner particle intermediate to drying. A drying treatment is conducted in the form of a toner cake. Drying machines usable in this step include a spray dryer, a vacuum freeze-dryer and a reduced-pressure dryer. Preferably, a standing plate dryer, a mobile plate dryer, a fluidized-bed dryer, a rotary dryer and a stirring dryer are employed. The moisture content of the dried toner particle intermediate is preferably not more than 5% by mass. When the dried toner particle intermediates are aggregated through weak inter-particle attractive forces, the aggregate may be subjected to a pulverization treatment. There can be employed mechanical pulverizing apparatuses, such as a jet mill, a Henschel mixer, a coffee mill and a food processor.

External Addition Step:

External additives are mixed into the dried toner particle intermediate (toner parent) to prepare a toner usable for image formation. Mechanical mixing apparatuses such as a Henschel mixer and a coffee mill are employed as an apparatus for mixing the external additives.

There will be described materials usable in the invention.

A binding resin constituting resin particles preferably contains a vinyl polymer obtained by polymerization of polymerizable monomers. Examples of such a polymerizable monomer include a carboxyl group-containing monomer and monomers usable in combination with the carboxyl group-containing monomer.

Specific examples of a carboxyl group-containing monomer include methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate and diethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; and acrylic acid or methacrylic acid derivatives such as acrylonitrile, methacrylonitrile and acrylamide.

Specific examples of a monomer usable in combination with the carboxyl group-containing monomer include styrene or styrene derivatives such as o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene; olefins such as ethylene, propylene and isobutylene; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone and vinyl hexyl ketone; N-vinyl compounds such as N-vinyl carbazole, N-vinyl indole and N-vinyl pyrrolidone; and vinyl compounds such as vinyl naphthalene.

It is more preferred to use a polymerizable monomer containing an ionic dissociative group, such as a carboxyl group, a sultonic acid group or a phosphoric acid group. Specific examples of such a monomer include acrylic acid, methacrylic acid, maleic acid, itaconic acid, cinnamic acid, fumaric acid, maleic acid monoalkyl ester, itaconic acid monoalkyl ester, styrenesulfonic acid, allysulfosuccinic acid, 2-acrylamodo-2-methylpropanesulfonic acid and acid phosphooxyethyl methacrylate.

It is also preferred to make a resin having a crosslinkage structure by using polyfunctional vinyl compounds, such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

Water-soluble radical polymerization initiators are preferably used in emulsion polymerization. Examples of such a water-soluble initiator include persulfates such as potassium persulfate and ammonium persulfate, azobisaminodipropane acetic acid salt, azobiscyanovaleric acid and its salt and hydrogen peroxide.

A resin constituting the toner of the invention preferably exhibits a number average molecular weight (Mn) of 1,000 to 100,000 and a weight average molecular weight (Mw) of 2,000 to 100,000. The molecular weight of a resin can be determined, for example, by gel permeation chromatography.

Determination of molecular weight is carried out in gel permeation chromatography (also denoted simply as GPC), according to the following procedure. First, 1 mg of a sample resin is added to 1 ml of tetrahydrofuran as a solvent, dissolved with stirring by a magnetic stirrer at room temperature, and then filtered with a membrane filter having a pore size of 0.45 to 0.50 μm to prepare a sample for GPC measurement. Subsequently, a GPC measurement column is maintained with heating at 40° C. and tetrahydrofuran is flowed through the column at a flow rate of 1 ml/min. A sample of 100 μl of a sample at a concentration of 1 mg/ml is injected and measured. The measurement column preferably uses the combination of commercially available polystyrene gel columns. Specific examples thereof include a combination of Shodex GPC KF-801, 802, 803, 804, 806 and 807 (produced by Showa Denko Co., Ltd.) and a combination of TSK gel G1000H, G2000H, G3000H, G4000H, G5000H, G6000H, G7000K and TSK guard Column (produced by TOSO Co.). There may be used a refractive index detector (IR detector) or a UV detector as a detector.

The number average molecular weight or the weight average molecular weight of a tetrahydrofuran-dissolved component of the resin particles is represented by a molecular weight converted to styrene resin. The molecular weight converted to styrene resin can be determined from a styrene calibration curve. The styrene calibration curve is prepared by measuring approximately 10 points of monodisperse polystyrene standard resin.

Commonly known inorganic or organic colorants are usable for the toner of the invention. Specific colorants are as follows.

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow colorants include C.I. Pigment Orange 31, C.I. Pigment Orange43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Green or cyan colorants include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66 and C.I. Pigment Green 7.

The foregoing colorants may be used alone or in combination. The colorant content is preferably from 1% to 30% by mass, and more preferably 2% to 20% by mass.

Generally used chain-transfer agents are usable for the purpose of controlling the molecular weight of a binding resin. Chain-transfer agents are not specifically limited but examples thereof include mercaptans such as n-octylmercaptan, n-decylmercaptane and tert-dodecylmercaptan, n-octyl-3-mercaptopropionic acid ester, terpinolene, carbon tetrabromide, carbon and α-methylstyrene dimmer.

Waxes usable in the toner of the invention are those known in the art. Examples thereof include polyolefin wax such as polyethylene wax and polypropylene wax; long chain hydrocarbon wax such as paraffin wax and sasol wax; dialkylketone type wax such as distearylketone; ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristarate, and distearyl meleate; and amide type wax such as ethylenediamine dibehenylamide and trimellitic acid tristearylamide. The wax content of the toner is preferably in the range of 1% to 20% by mass, and more preferably 3% to 15%.

The toner of the invention may optionally be added with a charge-controlling agent. Commonly known compounds as a charge-controlling agent are usable.

Commonly known inorganic particles are usable as an external additive. Preferred examples thereof include silica particles, titania particles, alumina particles and a composite oxide. Hydrophobic inorganic particles are also preferred. Organic particles usable as an external additive include spherical particles having a number-average primary particle size of 10 to 2000 nm. Constituent material of such organic particles include, for example, polystyrene, polymethyl methacrylate and styrene-methyl methacrylate copolymer.

The toner of the invention is usable as a mono-component developer or a dicomponent developer.

In cases when the toner is used as a monocomponent developer, a nonmagnetic monocomponent developer and a magnetic monocomponent developer which contains magnetic particles of 0.1 to 0.5 μm in the toner are cited and both are usable.

In cases when the toner is used as a dicomponent developer, magnetic particles composed of metals such as iron, ferrite or magnetite, or alloys of the foregoing metals and aluminum or lead are usable as a carrier, and of these, ferrite particles are specifically preferred. The particle size of the carrier is preferably 20 to 100 μm, and more preferably 25 to 80 μm.

The toner of the invention is used preferably as a nonmagnetic monocomponent developer in terms of compactness of the developing device and a low price.

Next, there will be described image forming apparatuses using the toner of the invention to perform image formation.

An example of a development method using the toner of the invention as a nonmagnetic monocomponent developer will be described below but the invention is not limited thereto.

FIG. 1 illustrates the section of a developing device used for a nonmagnetic monocomponent developer.

In FIG. 1, the numeral 14 designates a developing device used for a nonmagnetic monocomponent developer, the numeral 10 designates a latent image holder (photoreceptor drum), and latent image formation is performed by an electrophotographic process means or an electrostatic recording means which is not shown in the drawing. The numeral 14*a* designates a developing roller formed of a nonmagnetic aluminum or stainless steel sleeve.

The developing roller may use an aluminum or stainless steel pipe as such but preferably is one the surface of which is roughened by blowing glass beads, subjected to a mirror finish treatment, or coated with resin or the like.

Toner (T) is stocked in hopper 3 and supplied onto a toner carrier by supplying roller 4. The supplying roller, which is formed of a foam material such as polyurethane foam, rotates at a relative rate to the normal or reverse direction with respect to the toner carrier and performs stripping-off of a toner on the toner carrier after development (undeveloped toner), while performing toner-supplying. Toner supplied onto the toner carrier is thinly and uniformly coated by toner controlling blade 5 as a controlling member to form a thin layer of the toner.

The contact pressure between the toner controlling blade and the toner carrier is preferably 3 to 250 N/m as a linear pressure in the direction of a bus line of the sleeve, and more preferably from 5 to 12 N/m. A contact pressure of less than 3 N/m renders it difficult to perform uniform coating of the toner, resulting in a broad electrostatic charge distribution of the toner, which leads to causes for fogging or scattering. Contact pressure of more than 250 N/m applies excessive pressure to the toner, deteriorating the toner and causing unsuitable aggregation of the toner. It is unsuitable to require a large torque to drive the toner carrier. Thus, adjustment of a contact pressure to the range of 3 to 250 N/m renders it possible to effectively loosen an aggregated toner and also makes feasible instant rise of electrostatic charge of the toner.

The controlling member to form a thin toner layer is an n elastic blade, an elastic roller or the like which preferably employs material exhibiting a frictional electrification series suitable for charging-up of the toner at a desired polarity. Specifically, silicone rubber, urethane rubber and styrene-butadiene rubber are suitable in the invention. There may also be provided an organic resin layer of polyamide, polyimide, nylon, melamine, urethane-cured nylon, phenol resin, fluororesin, silicone resin, polyester resin, urethane resin, styrene resin or the like. The use of conductive rubber or conductive resin, or incorporation of fillers such as a metal oxide, carbon black, inorganic whiskers or inorganic fibers, or charge controlling agents into a rubber or resin of the blade gives a toner an appropriate dielectric property or charging property, resulting in an optimally charged toner.

In a system in which a toner is thinly coated on a developing roller by a blade, to attain a sufficient density, it is preferred to make the toner layer thickness on the developing roller smaller than the air gap between the developing roller and the photoreceptor drum and apply an alternating electric field at the gap. Thus, a development bias of an alternating electric field or a direct electric field superimposed on the alternating electric field is applied between the developing roller 14 and the photoreceptor drum 10 by bias supply 7, rendering it easier to transfer the toner from the developing roller to the photoreceptor drum, whereby superior images are obtained.

The toner of the invention is suitable used in the image forming process comprising the step of causing a recording material having formed a toner image to pass between a heating roller and a pressure roller to achieve fixing.

Figure 2:
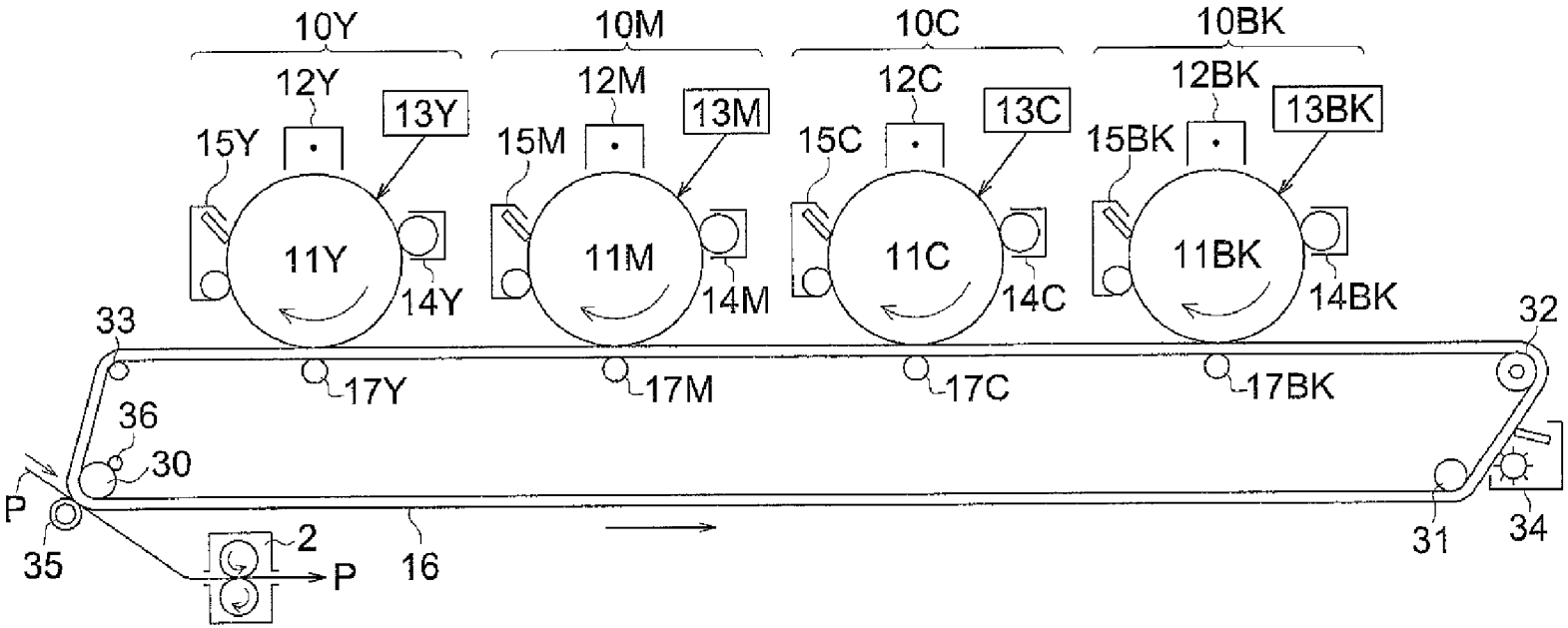
FIG. 2 illustrates the section of an example of a full-color image forming apparatus using the toner of the invention.

FIG. 2 illustrates the section of an example of a full-color image forming apparatus using the toner of the invention.

The full-color image forming apparatus shown in FIG. 2 is provided with units 10Y, 10M, 10C and 10BK; belt-form intermediate transfer body (or intermediate transfer belt) 16; transfer rollers 17Y, 17M, 17C and 17BK; a recording material conveying roller and fixing belt 2. In the invention, polyimide resin is preferably used as the material for the belt of the intermediate transferring body 16 or for an endless belt of fixing device 2 to be described later.

The units 10Y, 10M, 10C and 10BK are each provided with photoreceptor drums 11Y, 11M, 11C and 11BK which are rotatable at a prescribed circumferential speed in the clockwise direction indicated by the arrow. Corotron chargers 12Y, 12M, 12C and 12BK; exposure devices 13Y, 13M, 13C and 13BK; color-developing devices (yellow-developing device 14Y, magenta-developing device 14M, cyan-developing device 14C and black-developing device 14BK); and photoreceptor cleaner 15Y, 15M 15C and 15BK are disposed in the periphery of each of the photoreceptor drums 11Y, 11M, 11C and 11BK.

The units 10Y, 10M, 10C and 10BK are arranged parallel to the intermediate belt 16 in any order so as to fit the image forming method, for example, in the order of 10BK, 10Y, 10C and 10M.

The intermediate transfer belt 16 is rotatable in the counterclockwise, as indicated by the arrow, via back-up roller 30 and supporting rollers 31, 32 and 33 at a circumferential speed equivalent to the photoreceptor drums 11Y, 11M, 11C and 11BK and is disposed so that a part of the belt between the supporting rollers 32 and 33 is brought into contact with the photoreceptor drums 11Y, 11M, 11C and 11BK. The intermediate transfer belt 16 is provided with a cleaning device 34 for the belt. The supporting roller 31 plays a role as a rotation roller and is disposed so as to be movable in the direction of the face of the intermediate transfer belt 16, whereby the tension of the intermediate transfer belt 16 can be controlled.

The transfer rollers 17Y, 17M, 17C and 17BK are disposed inside the intermediate transfer belt 16 and positioned opposite the portion in contact with each of the photoreceptor drums 11Y, 11M, 11C and 11BK, and forms a primary transfer section (nip portion) to transfer a toner image to the photoreceptor drums 11Y, 11M, 11C and 11Bk and the intermediate transfer belt 16.

Bias roller 35 is disposed through the intermediate transfer belt 16 on the surface side having a toner image, opposite the backup roller 30. The secondary transfer section (nip portion) is formed between the bias roller 35 and the backup roller 30, intervened by the intermediate transfer belt 16. The backup roller 30 is provided with an electrode roller 36 which is in contact with the backup roller 30.

Fixing device 2 is disposed so that recording material P is conveyed after passing through the secondary transfer section.

In the unit 10Y of the image forming apparatus shown in FIG. 2, the rotatable photoreceptor drum 11Y is driven. In synchronization therewith, the corotron charger 12Y is driven to allow the surface of the photoreceptor drum 11Y to be uniformly charged to a prescribed polarity and potential. The thus uniformly surface-charged photoreceptor drum 11 is then exposed to light to form an electrostatic latent image on the surface thereof.

Subsequently, the electrostatic latent image is developed by the yellow-developing device 14Y to form a toner image on the surface of the photoreceptor drum 11Y.

When passing through the primary transfer section (nip portion) between the photoreceptor drum 11Y and the intermediate transfer belt, the toner image is transferred onto the peripheral surface of the intermediate transfer belt 16 by an electrostatic field formed by a transfer bias applied by the transfer roller 17.

Thereafter, a toner remaining on the photoreceptor drum 11Y is cleaned/removed by the photoreceptor cleaner 15Y. The photoreceptor drum 11Y is prepared for the subsequent transfer cycle.

Thus, the transfer cycle is similarly performed in the units 10M, 10C and 10BK to successively form the second color toner, third color toner image and fourth color toner image, which are superposed on the intermediate transfer belt to form a full-color image.

The full-color toner image transferred onto the intermediate transfer belt 16 reaches the secondary transfer section (nip portion) provided with the bias roller 35, by rotation of the transfer belt 16.

Recording material P is synchronously supplied to the secondary transfer section between the intermediate transfer belt 16 and the bias roller 35 at a predetermined timing. The toner image carried by the intermediate transfer belt 16 is transferred onto recording material P by pressure conveyance by the bias roller 36 and the backup roller 30 and by the driven intermediate transfer belt 16.

The recoding material P having the transferred toner image is conveyed to the fixing device 2 to fix the toner image by a pressure-heating treatment. The intermediate transfer belt 16 after completion of transfer, is subjected to removal of a remained toner by the belt-cleaning device 34 provided downstream of the secondary transfer section to prepare it for the next transfer.

Polyimide resin is preferred as a belt material, for the endless belt of the fixing device or for the intermediate transfer belt of the image forming apparatus relating to the invention.

Recording material used in the invention refers to a support capable of carrying a toner image and is usually called the image support, recording material or transfer paper. Specific examples thereof include a variety of recording materials, such as plain paper including light paper and heavy paper, coated printing paper, e.g., art paper or coated paper, commercially available Japanese paper or postcard paper, plastic film for OHP (overhead projector) and cloth, but are not limited to these.

EXAMPLES

Embodiments of the invention will be described with reference to the following examples but the present invention should not be construed as being limited thereto.

Resin Particle Dispersion 1

In a separable flask fitted with a stirrer, a temperature sensor, a condenser and a nitrogen-introducing device, 97.0 parts by weigh (also denoted as wt. parts) of sodium dodecylsulfate (having an effective content of 2.6 parts by mass) was dissolved in 1510 parts by mass of deionized water to prepare aqueous medium 1. Subsequently, a mixture composed of the following components was added to the aqueous medium 1:

| | |
|---|---|
| Styrene | 213 wt. parts |
| n-butyl acrylate | 62 wt. parts |
| Acrylic acid | 7 wt. parts |
| Pentaerythritol tetrastearate | 154 wt. parts |

To the foregoing aqueous medium 1, an initiator solution having the following composition was added and after raising the temperature to 82.5° C., polymerization was undergone over a period of 2 hrs.

| | |
|---|---|
| Aqueous hydrogen peroxide solution (effective content of 2.5 wt. parts) | 42 wt. parts |
| Aqueous sodium erythorbate solution (effective content of 6.5 wt. parts) | 42 wt. parts |
| n-Octylmercaptan | 0.6 wt. parts |

Subsequently, a monomer mixture as below was added thereto:

| | |
|---|---|
| Styrene | 542 wt. parts |
| n-Butyl acrylate | 157 wt. parts |
| Acrylic acid | 18 wt. parts |

and then, the following initiator solution was added:

| | |
|---|---|
| Aqueous hydrogen peroxide solution (effective content of 9 wt. parts) | 145 wt. parts |
| Aqueous sodium erythorbate solution (effective content of 23.5 wt. parts) | 153 wt. parts |
| n-Octylmercaptan | 8.2 wt. parts |

48 parts by mass of an aqueous sodium dodecylsulfate solution (having an effective content of 4.8 parts by mass) was further added thereto and after raising the temperature to 90° C., polymerization reaction was undergone over 1 hr. with stirring to prepare a resin particle dispersion. The thus prepared dispersion was designated as resin particle dispersion 1.

Colorant Particle Dispersion

Magenta colorant C.I. Pigment 122 was dispersed in deionized water so as to have a solid content of 12.5% by mass to prepare an aqueous dispersion. The thus prepared dispersion was designated as colorant particle dispersion.

Toner

Toner 1

Into a separable flask fitted with a stirrer, a thermometer, a condenser, a nitrogen-introducing device and a stirrer were placed 1700 parts by mass (solid content) of the resin particle dispersion 1, 2100 parts by mass of deionized water and 250 parts by mass of the colorant particle dispersion. While maintaining at a temperature of 30° C. within the flask, an aqueous sodium hydroxide solution (25% by mass) was added thereto and the pH was adjusted to 10.

Subsequently, an aqueous solution of 54.3 parts by mass of magnesium chloride hexahydrate, dissolved in 104.3 parts by mass of deionized water was added thereto. Then, the temperature was raised to 75° C. to undergo coagulation of resin particles and colorant particles. After starting coagulation, sampling was done periodically to determine the particle size by using a particle size distribution-measuring instrument, Coulter Multisizer III (produced by Beckman Coulter Corp.). When the volume-based median diameter ($D_{50}$) reached 5.8 μm, 40.2 parts by mass of iminocarboxylic acid compound (8-3) was added thereto and further stirred.

When the circularity of particles reached 0.976, the temperature of the reaction mixture was lowered to 30° C. to terminate coagulation reaction to obtain a dispersion of Colored Particle 1. The thus obtained Colored Particle 1 exhibited a volume-based median diameter ($D_{50}$) of 5.8 μm and a coefficient of variation of volume-based particle size distribution of 18.8%.

Then, the dispersion of Colored Particle 1 was subjected to solid-liquid separation by using basket type centrifugal separator MARK III type (type No. 60×40, produced by Matsumoto Kikai Seisakusho) to form a wet cake of Colored Particle 1. Thereafter, washing and solid-liquid separation of Colored Particle 1 was repeated until the filtrate reached an electric conductivity of 15 μS/cm.

The final wet cake was moved to an airflow dryer, Flash Jet Dryer (produced by Seishin Kigyo) and Colored Particle 1 was dried until reached a moisture content of 0.5% by mass. Drying was conducted by blowing airflow at 40° C. and 20% RH.

To thus dried Colored Particle 1, hydrophobic silica exhibiting a number-average primary particle size of 12 nm and a hydrophobicity of 68 and hydrophobic titanium oxide exhibiting a number-average primary particle size of 80 nm and a hydrophobicity of 63 were added in amounts of 1% by mass and 1% by mass, respectively, using a Henschel mixer to obtain Toner 1. The volume-based median diameter ($D_{50}$) and the coefficient of variation of volume-based particle size distribution of thus obtained Toner 1 were the same as the foregoing measured values.

Toner 2

Toner 2 was prepared similarly to Toner 1, provided that the aqueous solution of 54.3 parts by mass of magnesium chloride hexahydrate, dissolved in 104.3 parts by mass of deionized water was replaced by an aqueous solution of 108.6 parts by mass of magnesium chloride hexahydrate, dissolved in 160.8 parts by mass of deionized water and when the volumes based median diameter ($D_{50}$) reached 3.1 μm after starting coagulation, 120.6 parts by mass of iminocarboxylic acid compound (8-3) was added thereto.

Toner 3

Toner 3 was prepared similarly to Toner 1, provided that the aqueous solution of 54.3 parts by mass of magnesium chloride hexahydrate, dissolved in 104.3 parts by mass of deionized water was replaced by an aqueous solution of 162.9 parts by mass of magnesium chloride hexahydrate, dissolved in 198.0 parts by mass of deionized water and when the volume-based median diameter ($D_{50}$) reached 8.9 μm after starting coagulation, 103.8 parts by mass of tetra-sodium salt of iminocarboxylic acid compound (8-3), also denoted as 8-3(Na), was added thereto.

Toner 4

Toner 4 was prepared similarly to Toner 1, provided that the aqueous solution of 54.3 parts by mass of magnesium chloride hexahydrate, dissolved in 104.3 parts by mass of deionized water was replaced by an aqueous solution of 45.7 parts by mass of aluminum sulfate, dissolved in 104.3 parts by mass of deionized water and 40.2 parts by mass of iminocarboxylic acid (8-3) was replaced by 36.4 parts by mass of iminocarboxylic acid compound (9-2).

Toner 5

Toner 5 was prepared similarly to Toner 4, provided that the aqueous solution of 45.7 parts by mass of aluminum sulfate, dissolved in 104.3 parts by mass of deionized water was replaced by an aqueous solution of 91.4 parts by mass of aluminum sulfate, dissolved in 160.8 parts by mass of deionized water and 40.2 parts by mass of iminocarboxylic acid (8-3) was replaced by 36.4 parts by mass of iminocarboxylic acid compound (9-2) and when reached a volume-based median diameter ($D_{50}$) of 7.5 μm after starting coagulation, 48.3 parts by mass of tetra-sodium salt of iminocarboxylic acid compound (9-2), also denoted as 9-2(Na)a, was added thereto.

Toner 6

Toner 6 was prepared similarly to Toner 4, provided that the aqueous solution of 45.7 parts by mass of aluminum sulfate, dissolved in 104.3 parts by mass of deionized water was replaced by an aqueous solution of 137.1 parts by mass of aluminum sulfate, dissolved in 201.3 parts by mass of deionized water and 40.2 parts by mass of iminocarboxylic acid (8-3) was replaced by 36.4 parts by mass of iminocarboxylic acid compound (9-2) and when reached a volume-based median diameter ($D_{50}$) of 4.0 μm after starting coagulation, 96.6 parts by mass of tetra-sodium salt of iminocarboxylic acid compound (9-2) was added thereto.

Toner 7

Toner 7 was prepared similarly to Toner 1, provided that 40.2 parts by mass of iminocarboxylic acid compound (8-3) was replaced by 34.2 parts by mass of iminocarboxylic acid compound (9-3).

Toner 8

Toner 8 was prepared similarly to Toner 7, provided that 34.2 parts by mass of iminocarboxylic acid compound (9-3) was replaced by 65.4 parts by mass of tetra-sodium salt of iminocarboxylic acid compound (9-3), also denoted as 9-3 (Na).

Toner 9

Toner 9 was prepared similarly to Toner 7, provided that 34.2 parts by mass of iminocarboxylic acid compound (9-3) was replaced by 92.1 parts by mass of tetra-sodium salt of iminocarboxylic acid compound (9-3).

Toner 10

Toner 10 was prepared similarly to Toner 1, provided that the amount of iminocarboxylic acid compound (8-3) was varied from 40.2 parts by mass to 20.1 parts by mass.

Toner 11

Toner 11 was prepared similarly to Toner 3, provided that the amount of tetra-sodium salt of iminocarboxylic acid compound (8-3) was varied from 103.8 parts by mass to 106.8 parts by mass.

Toner 12

Toner 12 was prepared similarly to Toner 1, provided that 40.2 parts by mass of iminocarboxylic acid compound (8-3) was replaced by 26.4 parts by mass of iminocarboxylic acid compound (9-2).

Toner 13

Toner 13 was prepared similarly to Toner 1, provided that 40.2 parts by mass of iminocarboxylic acid compound (8-3) was replaced by 112.2 parts by mass of iminocarboxylic acid compound (9-3).

Toner 14

Toner 14 was prepared similarly to Toner 2, provided that when reached a volume-based median diameter ($D_{50}$) of 5.8 μm after starting coagulation, addition of 120.6 parts by mass of iminocarboxylic acid compound (8-3) was replaced by that of 53.3 parts by mass of comparative compound A as below.

Compound A

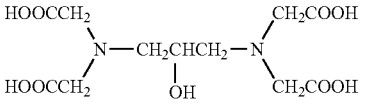

Toner 15

Toner 15 was prepared similarly to Toner 2, provided that when reached a volume-based median diameter ($D_{50}$) of 5.8 μm after starting coagulation, addition of 120.6 parts by mass of iminocarboxylic acid compound (8-3) was replaced by that of 48.0 parts by mass of comparative compound B as below.

Compound B

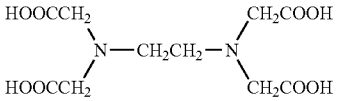

Toner 16

Toner 16 was prepared similarly to Toner 15, provided that 48.0 parts by mass of the comparative compound B was replaced by 62.5 parts by mass of tetra-sodium salt of the comparative compound B, i.e., ethylenediaminetetraacetic acid tetra-sodium salt or denoted as B(Na).

Toners 1-16 are shown in Table 1, with respect to iminocarboxylic acid compounds, comparative compounds and their added amounts and contents of the toner, sodium (Na) content, di0 or tri-valent metal content and volume-based median diameter ($D_{50}$) of the respective toner particles.

TABLE 1

| Toner No. | Iminocarboxylic Acid (parts by mass)*1 | Content: Iminocarboxylic Acid (ppm) | Content: Sodium (ppm) | Content: Di- or Tri-valent Metal (ppm) | $D_{50}$ (μm) |
|---|---|---|---|---|---|
| 1 | 8-3 (40.2) | 31 | 2 | 311 | 5.8 |
| 2 | 8-3 (120.6) | 91 | 3 | 752 | 3.1 |
| 3 | 8-3(Na) (103.8) | 388 | 134 | 1796 | 8.9 |
| 4 | 9-2 (36.4) | 28 | 1 | 620 | 5.8 |
| 5 | 9-2(Na) (48.3) | 181 | 65 | 1080 | 7.5 |
| 6 | 9-2(Na) (96.6) | 361 | 115 | 1390 | 4.0 |
| 7 | 9-3 (34.2) | 26 | 1 | 611 | 5.8 |
| 8 | 9-3(Na) (65.4) | 245 | 78 | 610 | 5.8 |

TABLE 1-continued

| Toner No. | Iminocarboxylic Acid (parts by mass)*1 | Content: Iminocarboxylic Acid (ppm) | Content: Sodium (ppm) | Content: Di- or Tri-valent Metal (ppm) | $D_{50}$ (μm) |
|---|---|---|---|---|---|
| 9 | 9-3(Na) (92.1) | 344 | 120 | 614 | 5.8 |
| 10 | 8-3 (20.1) | 15 | 2 | 615 | 5.8 |
| 11 | 8-3(Na) (106.8) | 400 | 140 | 618 | 5.8 |
| 12 | 9-2 (26.4) | 20 | 1 | 616 | 5.8 |
| 13 | 9-3(Na) (112.2) | 420 | 155 | 616 | 5.8 |
| 14 | A (53.3) | 200 | 3 | 1252 | 5.8 |
| 15 | B (48.0) | 180 | 3 | 1251 | 5.8 |
| 16 | B(Na) (62.4) | 185 | 80 | 1254 | 5.8 |

*1Amount added in preparation of toners

Evaluation

Toners 1-16 were used as a nonmagnetic monocomponent developer.

A commercially available color laser printer (Magicolor 5430DL, produced by Konica Minolta Business Technology Inc.) was modified as an image forming apparatus to be used for evaluation, in which only a magenta toner was outputted and the print rate was set to approximately two times the commercially set rate (300 mm/sec). Using this printer, Toners 1-16 were each evaluated under the condition of high specifications. Evaluation using only a magenta toner is based on the reason that the use of the magenta toner became an evaluation mode which can easily detect problems to be solved in the present invention, specifically, filming of the developing roller (that is, occurrence of filming is easily noted with a magenta toner).

When the toner remainder diminished in a toner cartridge, the printer was once stopped to supply an additional toner and evaluation continued without exchanging the developing roller.

Toner Scattering

An A4-size image at a pixel ratio of 75% was continuously printed onto 2,000 sheets of A4-size fine-quality paper (65 g/m$^2$) and immediately after that, a text image of a pixel ratio of 3.5% was printed. In an image exhibiting a relative high pixel ratio, the residence-time of a toner in the development unit was short and development was performed by frictional electrostatic-charging over a short period. Toner scattering after continuous printing of images at a relatively high pixel ratio was evaluated based on the following criteria.

A: neither toner-scattering around the text image nor togging was observed, resulting in a superior image not differing from normal conditions; no toner-scattering was observed around the development unit in such a state that even when exchanging the development unit or toner cartridge, the operator's hands were not stained, B: neither toner-scattering around the text image nor fogging was observed, resulting in a superior image not differing from normal conditions, but slight toner-scattering was observed around the development unit, C: slight toner-scattering was noted around the text image or fogging was noted, and toner-scattering was also observed around the development unit, D: toner-scattering was noted around a text image and fogging was observed over the whole image, which is at an unacceptable level as a business document, and a lots of toner-scattering was also observed around the development unit.

Density-Lowering

Lowering of density under low temperature and low humidity was evaluated in such a manner that printing was performed on 5,000 sheets of A4-size fine-quality paper (65 g/m$^2$) under an environment of low temperature and low humidity (10° C., 20% RH) and image densities in the image area at the start of and completion of printing of the 5,000 sheets were measured and evaluated. The image density was measured using a reflection densitometer RD-918 (produced by Macbeth Co.). Evaluation was made based on the following criteria:

A: density lowering of less than 0.01 between start and completion of printing of 5,000 sheets (which was rated as superior), B: density lowering of not less than 0.01 and less than 0.04 between start and completion of printing of 5,000 sheets (which was rated as good), C: density lowering of not less than 0.04 between start and completion of printing of 5,000 sheets (which was rated as inferior).

Lifetime of Developing Roller

Long-run tests at higher than normal specification were conducted at an increased toner-filling content by using a reformed toner cartridge to evaluate the lifetime of a developing roller. Continuously printing text images (at a pixel ratio of 3.5%) on A4-size fine-quality paper (65 g/m$^2$) was conducted under an environment of low temperature and low humidity (10° C., 20% RH). Abrasion loss of the developing roller was measured and toner-filming on the surface of the developing roller and print image quality were visually observed at intervals of printing of 2,000 sheets. Lifetime of the developing roller was evaluated based on the following criteria.

A: an abrasion loss of the developing roller of less than 1 μm and no occurrence of toner-filming, leading to superior image quality after completion of printing of 10,000 sheets, and the lifetime of the developing roller being judged to be more than 10,000 printed sheets of, B: an abrasion loss of the developing roller being not less than 1 μm and less than 3 μm and slight toner-filming being observed after completion of printing of 10,000 sheets, and the lifetime of the developing roller being judged to be more than 7,000 printed sheets, C: an abrasion loss of the developing roller being not less than 3 μm and less than 5 μm and slight toner-filming being observed after completion of printing of 10,000 sheets, and the lifetime of the developing roller being judged to be more than 5,000 printed sheets, D: the test was discontinued due to deteriorated image quality after 5,000 printed sheets; toner-filming was too marked to measure abrasion loss of the developing roller; the lifetime of the developing roller was estimated to be approximately 2,000 printed sheets and it was judged to be difficult to expect further enhanced specifications.

Evaluation results are shown in Table 2.

TABLE 2

| Example No. | Toner No. | Toner Scattering | Density Lowering | Lifetime of Developing Roller |
|---|---|---|---|---|
| 1 | 1 | B | B | B |
| 2 | 2 | B | B | A |
| 3 | 3 | A | B | B |
| 4 | 4 | A | A | A |
| 5 | 5 | A | A | A |
| 6 | 6 | A | A | A |

TABLE 2-continued

| Example No. | Toner No. | Toner Scattering | Density Lowering | Lifetime of Developing Roller |
|---|---|---|---|---|
| 7 | 7 | B | A | B |
| 8 | 8 | A | A | B |
| 9 | 9 | A | A | B |
| Comp. 1 | 10 | D | B | C |
| Comp. 2 | 11 | D | B | C |
| Comp. 3 | 12 | D | B | C |
| Comp. 4 | 13 | D | B | C |
| Comp. 5 | 14 | D | B | D |
| Comp. 6 | 15 | D | B | D |
| Comp. 7 | 16 | D | B | D |

As apparent from the evaluation results shown in Table 2, it was proved that Toners 1-9 used in Examples 1-9 were superior in any of all evaluations. Toners 10-16 of Comparative Examples 1-7 produced problems in evaluation.

What is claimed is:

1. An electrostatic image developing toner comprising a resin and a colorant, wherein the toner contains at least one iminocarboxylic acid or its salt in an amount of 26 to 388 ppm by mass; and wherein the iminocarboxylic acid is at least one selected from the group consisting of the following compounds:

(8-3)

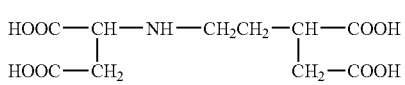

(9-2)

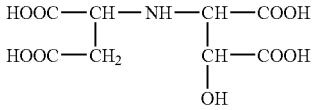

(9-3)

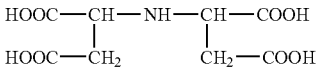

(9-4)

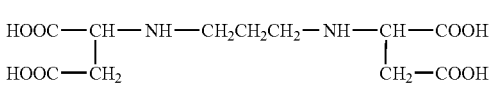

(9-5)

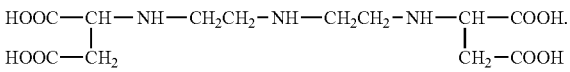

2. The toner of claim 1, wherein the toner contains at least one selected from the group consisting of compounds (8-3), (9-2) and (9-3) or its sodium salt.

3. The toner of claim 1, wherein the toner contains a sodium element in an amount of 1 to 134 ppm by mass.

4. The toner of claim 1, wherein the toner contains a divalent or trivalent metal element in an amount of 300 to 1800 ppm by mass.

5. The toner of claim 4, wherein the divalent or trivalent metal element is at least one of the group consisting of calcium, magnesium, manganese, copper, zinc, aluminum and iron.

6. The toner of claim 1, wherein the toner contains a sodium element in an amount of 1 to 134 ppm by mass and a divalent or trivalent metal element in an amount of 300 to 1800 ppm by mass.

* * * * *